United States Patent [19]

Palmer

[11] 4,358,760

[45] Nov. 9, 1982

[54] PORTABLE FIRE ALARM APPARATUS

[76] Inventor: James Palmer, P.O. Box 1248, Jackson, N.J. 08527

[21] Appl. No.: 256,853

[22] Filed: Apr. 23, 1981

[51] Int. Cl.[3] ..... G08B 17/06; G08B 17/10

[52] U.S. Cl. ..... 340/586; 220/4 E; 220/DIG. 26; 340/628; 340/630; 340/693

[58] Field of Search ..... 340/584, 586, 628, 629, 340/630, 693; 220/4 E, DIG. 26; 368/11, 278, 297, 298, 313, 316

[56] References Cited

U.S. PATENT DOCUMENTS

| | | | |
|---|---|---|---|
| 2,158,155 | 5/1939 | Roy | 220/DIG. 26 |
| 3,162,997 | 12/1964 | Schmidt | 368/276 |
| 3,878,539 | 4/1975 | Gooding | 340/584 X |
| 3,882,477 | 5/1975 | Mueller | 340/584 X |
| 3,943,499 | 3/1976 | Dunphy | 340/578 X |
| 3,980,997 | 9/1976 | Berns et al. | 340/630 |

*Primary Examiner*—John W. Caldwell, Sr.
*Assistant Examiner*—Joseph E. Nowicki
*Attorney, Agent, or Firm*—Arthur L. Plevy

[57] ABSTRACT

There is disclosed a portable fire alarm apparatus which comprises a foldable housing consisting of a base assembly having a surface for resting upon a horizontal plane. A central section is pivotally mounted to the base assembly to extend in the vertical plane. Pivotally mounted to the top of the central section is a top planar section which is pivotally mounted and adapted to be positioned in the horizontal plane where it is above and parallel to the base assembly and held in position by means of lockable hinges. The top section contains a smoke or heat detector with the central section containing a speaker or an alarm, with the base section containing electrical circuitry and a power source for alarm operation. The central section has an internal surface which is concave to act as a sounding surface for the audio signal indicative of an alarm condition. The base assembly contains a test indicator which operates in conjunction with a switch to enable a user to turn the unit OFF when not in use and to test for proper battery voltage when the unit is in the unfolded or folded state.

10 Claims, 5 Drawing Figures

PORTABLE FIRE ALARM APPARATUS

BACKGROUND OF INVENTION

This invention relates to fire alarm apparatus and more particularly relates to a compact portable unit which is capable of detecting a high heat and smoke condition to sound an alarm.

As can be ascertained, fire causes the loss of life and property each and every year. In our present society, hotel and motel fires have caused excessive life loss due to the fact that proper alarms, as well as, various other reasons prevented the occupants from leaving the premises. The prior art cognizant of such problems attempted to provide a portable fire alarm systems which could be carried by a traveller or other person to provide a person with a personal warning of an alarm condition and to therefore allow the person to leave the premises.

U.S. Pat. No. 1,199,050 entitled FIRE ALARM issued on Sept. 26, 1916 to C. J. Cid. This Patent shows an alarm system which employs a temperature gauge coupled to a shaft and a rod which will energize an alarm when the temperature exceeds a pre-set value. The unit is used in a bulky box.

U.S. Pat. No. 3,095,556 entitled FIRE ALARM UNIT issued on June 25, 1963 to R. W. Fuller. This Patent shows a portable alarm system which uses a fusable cartridge and a siren. The unit depicted is in a unitary box-like housing and requires a replacement of the fuse once a unit is activated.

U.S. Pat. No. 3,430,219 entitled FIRE ALARM issued to J. C. Powers on Feb. 25, 1969. This Patent depicts a portable fire alarm which can be used in a building and produces an odor and a visual indication when an alarm conditon is detected. The alarm is also housed in a bulky assembly.

Other patents such as U.S. Pat. No. 3,753,256 entitled FIRE ALARM SYSTEMS issued on Aug. 4, 1973 to McDonald showing a bellows structure which can activate an alarm and is also contained in a bulky housing.

Various other patents such as U.S. Pat. No. 3,827,039 and U.S. Pat. No. 3,943,499 show different structures relating to fire alarms and in general are bulky and unreliable devices. Such devices are not adaptable for use by a traveller due to the size of the package and the dimensions. Many of these devices suffer in that they do not adequately respond to a fire alarm condition due to the structure of the device. It is therefore an object of the present invention to provide a portable fire alarm unit, which unit is extremely compact and capable of being unfolded to place the unit in use while providing a small volume package during storage. The unit to be described is capable of responding to a heat as well as, a smoke condition to inform a user of the possibility of a fire and therefore to provide an adequate and suitable warning.

BRIEF DESCRIPTION OF THE PREFERRED EMBODIMENT

A portable fire alarm apparatus comprises a base assembly housing having a flat bottom surface for supporting the same on a horizontal surface, left and right sidewalls, with a front and back wall, said base assembly having an internal hollow, a central housing section pivotally mounted to the back wall of said base section at a first end of said central section, with said central section having a top concave surface with an inner convex surface with left and right sidewalls, with said central section when pivoted extending upwardly and transverse to said base assembly, a top planar section pivotally mounted to the top of said central section and capable of being positioned parallel to and above said base assembly, means coupling said central section to said top section for holding the same in said position, fire detection means located on the surface of said top planar section as facing said base assembly, electrical circuit means located in said internal hollow of said base section, audio alarm indicating means located centrally on the inner surface of said central section, and, flexible cable means directed from said circuit means in said base section for electrically connecting said detection means and said alarm means with said electrical circuit means, with said cable directed upwardly from said base section to said top section.

DETAILED DESCRIPTION OF THE FIGURES

Figure 1:
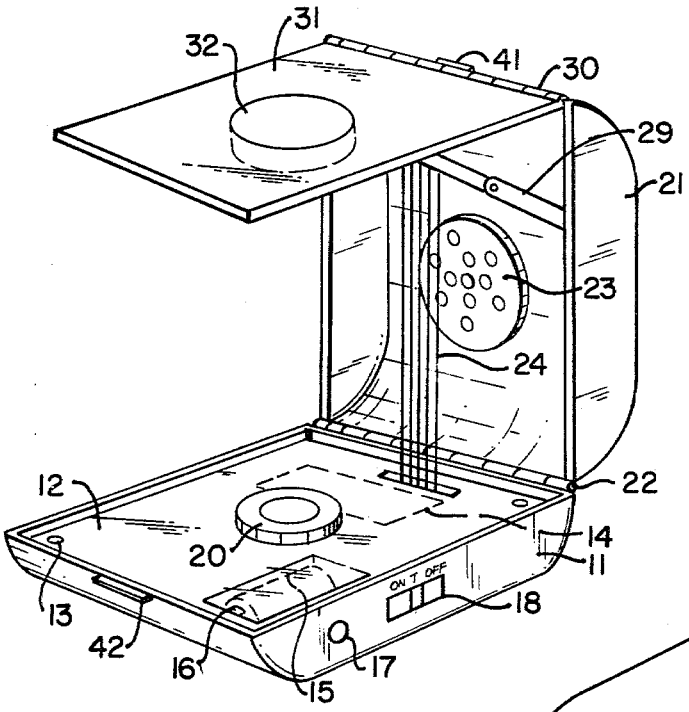
FIG. 1 is a perspective plan view of a portable fire alarm apparatus according to this invention.

Referring to FIG. 1 there is shown a perspective plan view of a portable fire detector 10 according to this invention. The unit 10 basically consists of three subassemblies which are hinged or pivotally mounted with respect to one another. As shown in FIG. 1, a base assembly 11 has a relatively flat bottom surface to enable it to rest upon a table, dresser or other location. The base assembly 11 is a hollow housing which has a top removable plate 12 secured to the assembly by means of suitable fasteners as 13. The base assembly contains within the hollow, a printed circuit board 14 which, as will be explained, carries the integrated circuitry for operating the alarm system. Also included within the base assembly 11 is a battery 15 which is the power source for the alarm unit. The battery is accessable through a covered opening 16 in the top plate 12. The cover 16 is a plastic cover which is easily removable to enable the consumer or user to gain access to the enclosed battery. Located on the side surface of the base assembly 11 is an indicator or lamp device 17. The lamp 17, which may be a LED (light emitting diode) is employed to provide a visual indication of the battery voltage. In this manner the user before employing the unit 10 can test the battery by means of the slide switch 18 also positioned on the sidewall. The slide switch 18 is a three position switch which specifies an ON position, a CENTER TEST position and an OFF position. As will be explained, the test position connects the battery to the LED 17 to indicate battery strength to the consumer. Also shown mounted on the top surface 12 is a photo cell or a photo transistor. These devices will respond to a beam of light impinging upon the same to provide a resistance value as is known in the art. As will be explained, the use of the photo cell is an optional structure.

Shown mounted to the base assembly 11 is a central vertical assembly 21 which assembly is mounted to the base 11 by means of a hinge 22. The central section 21 has a rounded surface to provide a concave outer surface to form a convex inner surface. The central section 21 has a substantial left and right sidewall with a relatively narrow top and bottom wall. The convex inner surface forms a sounding board which serve to directionally reflect sound waves which emanate from the speaker 23 in a directional pattern to enable the user to receive a maximum alarm during the detection of an alarm condition.

The central assembly 21 contains an annunciator or alarm 23. Essentially, the alarm 23 may be a ceramic speaker or a miniature acoustic transducer to provie an audible alarm signal. The alarm 23 is connected to the integrated circuit board 14 via a flexible cable 24. Cables such as 24 are available commercially and essentially constitute flat conductors which are imbedded or positioned in a mylar sheath and are known as printed circuit cables. The cable 24 is completely flexible.

Hingedly coupled to the central assembly 21 via a hinge 30 is a top platform 31. The platform 31 can be locked in the horizontal plane by means of hinges as 29 which hinges and structures are well known. The top assembly 31 contains a heat detector 32 which may be a thermistor or some other heat sensitive device and also may include a light source for cooperating with the photo cell 20 as will be explained. The detector 32 may be a heat detector as a thermistor, a smoke detector as a radio active element smoke detector, a photo cell smoke detector or a combination smoke and heat detectors all of which are well known in the art.

Figure 2:
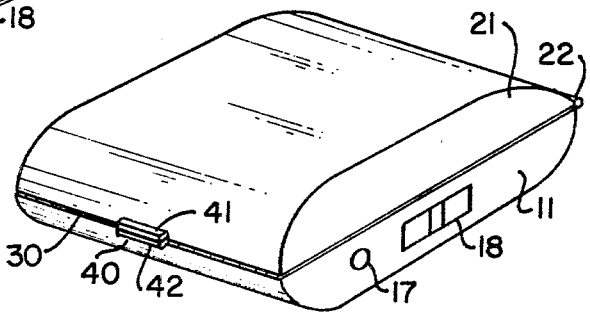
FIG. 2 is a plan view depicting the apparatus in a folded state.

As can be seen from FIGS. 1 and 2, the entire assembly can be folded to form a compact clam shelled configuration. A latch mechanism 40 holds the assembly in a closed position by means of a first latch member 41 associated with the central assembly 21 and a second latch member 42 associated with the base assembly 11. As can be seen from FIG. 1, the top assembly 31 folds into the central assembly 21 which is then closed upon the base assembly to provide the configuration depicted in FIG. 2. The detector 32 is electrically connected to the printed circuit board 11 via the flexible cable 24.

Figure 3:
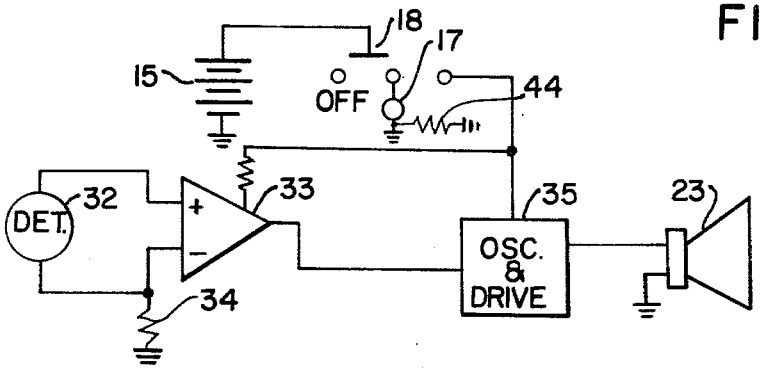
FIG. 3 is a simple schematic circuit diagram.

Referring to FIG. 3, there is shown a simple circuit schematic of the assembly employing a heat detector 32. The heat detector 32 is connected to the input of a level comparator circuit 33. The comparator circuit 33 is a conventional component and will provide an output signal when the input exceeds a predetermined value. If detector 33 is a thermistor, it will provide an increasing or a decreasing resistance as the ambient temperature changes. A threshold value for the comparator is specified by means of a resistor or divider 34. The comparator will provide an output which output will activate an oscillator 35. The oscillator 35 may be a conventional astable multivibrator and a transistor driver amplifier for providing an audio signal to the speaker or alarm 23. The circuitry is biased by means of the battery 15 which may be a 9 voltage battery. Also shown in FIG. 3 is the test switch 18 which is a slide switch. The left position where the battery is completely disconnected from the circuit is designated as the OFF position. The center position is a test position where the battery is connected to the LED 17 in series with a resistor 44. If the battery voltage is low or below the level necessary to operate the circuit the LED will not illuminate indicating that battery replacement is necessary. In the extreme right position the battery is connected to the circuit to specify an ON condition and the LED is electrically removed from the circuit.

Figure 4:
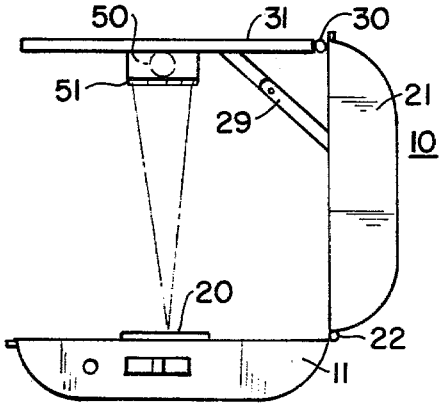
FIG. 4 is a simple diagram depicting a photo cell smoke detector.

Referring to FIG. 4, there is shown a side schematic of the housing depicting the use of a light source 50 with a lens 51 coupled to the top section 31. As can be seen from the side view of FIG. 4, the unit 10 when unfolded has the appearance of a C shaped assembly with a central section 21 forming the center of the C and the top and bottom sections form the top and bottom arms. The light source 50 is a LED having its light output concentrated by means of the focusing lens 51. Lens 51 may be a plastic lens which is a simple convex lens. The lens 51 concentrates the beam of light upon the surface of the photo detector and the resistance is a function of the light impinging upon its surface. Hence, if the room is filled with smoke, the smoke will block the light as is known causing the resistance to change.

Figure 5:
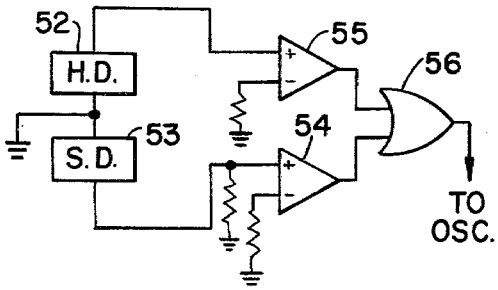
FIG. 5 is a schematic diagram showing a combined heat and smoke detecting circuit.

Referring to FIG. 5 there is shown a circuit schematic employing a heat detector 52 and a smoke detector 53 in the same circuit. The smoke detector 53 is a photo cell which is connected to a first comparator 54. Comparator 54 will provide an output when the photo cell resistance is at a value indicative of a dangerous smoke level. The heat detector 52 is coupled to a comparator 55 (as comparator 53 of FIG. 3) to provide an output when the temperature exceeds a safe value. The outputs of comparator 54 and 55 are connected to the inputs of a OR gate 56. Hence if the temperature or smoke content exceeds a predetermined value the gate 56 will provide an output in either case to energize the oscillator 35 and hence to warn the consumer of a dangerous condition.

Thus there is disclosed a unique portable fire alarm unit which employs a compact packaged alarm. The unit is relatively small and for example, may be 3" in length, 2" in width and 2" high as shown in FIG. 2. The top section 31 is spaced from the base assembly 11 by 3" which is the length of the central section 21. The unit enables the user to test for battery life without activating the alarm. The unit also enables one to disconnect the battery when the alarm is not in its monitoring position (FIG. 1). The packaging arrangement as indicated allows the entire unit to fold into a closed clam shelled case when not in use and allows for battery testing in a closed position as shown in FIG. 2. The central section is concave and holds the alarm unit 23. The concave surface provides a sounding board which will deflect sound waves from the annunciator in a wide spread pattern. Thus the unit is extremely compact and reliable.

Various modifications and alterations of the above described structure will become apparent to those skilled in the art upon reading of this specification and all such embodiments are deemed to be encompassed within the spirit and scope of the claims appended hereto.

I claim:

1. A portable fire alarm apparatus, comprising:

a base assembly housing having a flat bottom surface for supporting the same on a horizontal surface, left and right sidewalls, with a front and back wall, said base assembly having an internal hollow, a central housing section pivotally mounted to the back wall of said base section at a first end of said central section, with said central section having a top convex surface with an inner concave surface with left and right sidewalls, with said central section when pivoted extending upwardly and transverse to said above assembly, a top planar section pivotally mounted to the top of said central section and capable of being positioned parallel to and above said base assembly, means coupling said central section to said top section for holding the same in said position, fire detection means located on the surface of said top planar section as facing said base assembly, electrical circuit means located in said internal hollow of said base section, audio alarm indicating means located centrally on the inner surface of said central section, and, flexible cable means directed from said circuit means in said base section for electrically connecting said detection means and said alarm means with said electrical circuit means, with said cable directed upwardly from said base section to said top section.

2. The fire alarm apparatus according to claim 1 wherein said base assembly includes a first latching means located in said front wall with said central section including a corresponding latching means located at said top, whereby when said top section is pivoted parallel to said central section, said central section can pivot to said base assembly with said latching means securing the apparatus together.

3. The fire alarm apparatus according to claim 1 wherein said base assembly further includes a battery located in said hollow for biasing said circuitry.

4. The fire alarm apparatus according to claim 3 further including an indicator light located on a sidewall of said base assembly and a switch having a test position for connecting the terminal of said battery to a terminal of said light to cause said light to provide a visual indication of battery voltage independent of the orientation of said base, central and top sections.

5. The fire alarm apparatus according to claim 1 wherein said fire detection means is a smoke detector.

6. The fire alarm apparatus according to claim 1 wherein said fire detection means is a heat detector.

7. The fire alarm apparatus according to claim 1 wherein said alarm indicating means is an audio speaker mounted on said concave inner surface, with said surface providing a sound deflection surface to distribute audio signals in a widespread directional pattern.

8. The fire alarm apparatus according to claim 4 wherein said switch further includes an ON position for connecting said battery to said electrical circuitry and an OFF position for disconnecting said battery from said electrical circuitry and from said indicator light.

9. The apparatus according to claim 1 wherein said means coupling said central section to said top section includes first and second lockable hinge assemblies located between the side surfaces of said top and central sections to hold said top section transverse to said central section.

10. The apparatus according to claim 1 wherein said electrical circuitry includes an audio oscillator for providing at an output an audio signal indicative of an alarm and means coupling said oscillator output to said alarm speaker.

* * * * *